United States Patent [19]

Wildman

[11] 4,236,343

[45] Dec. 2, 1980

[54] TOY POWER TOOL

[75] Inventor: John R. Wildman, North Riverside, Ill.

[73] Assignee: Marvin Glass & Associates, Chicago, Ill.

[21] Appl. No.: 10,834

[22] Filed: Feb. 9, 1979

[51] Int. Cl.[3] ..... A63H 33/30

[52] U.S. Cl. ..... 46/39; 46/192

[58] Field of Search ..... 46/39, 192, 174, 111, 46/112, 113, 114, 254, 175; 30/391, 370

[56] References Cited

U.S. PATENT DOCUMENTS

| | | | |
|---|---|---|---|
| 1,361,386 | 12/1920 | Kalamen | 46/114 |
| 2,487,327 | 11/1949 | Ganter, Jr. | 30/370 |
| 2,672,707 | 3/1954 | Greenhaus | 46/39 |
| 2,729,021 | 1/1956 | Lohr | 46/112 |
| 2,781,609 | 2/1957 | Allen | 46/209 |
| 2,914,885 | 12/1959 | Milligan | 46/39 |
| 2,922,250 | 1/1960 | Ayala | 46/39 |
| 3,036,402 | 5/1962 | Hamilton | 46/39 |
| 3,064,389 | 11/1962 | Lemelson | 46/209 |
| 3,190,031 | 6/1965 | Tengelitsch | 46/39 |
| 3,491,479 | 1/1970 | Carter | 46/39 |
| 3,859,749 | 1/1975 | Morin et al. | 46/39 |

FOREIGN PATENT DOCUMENTS

| | | | |
|---|---|---|---|
| 1098870 | 2/1961 | Fed. Rep. of Germany | 46/254 |

*Primary Examiner*—Gene Mancene
*Assistant Examiner*—John J. Wilson
*Attorney, Agent, or Firm*—Mason, Kolehmainen, Rathburn & Wyss

[57] ABSTRACT

A toy power tool is disclosed which includes the provision of an external housing in the shape of a power tool including a handle portion for grasping by the user. A sounding device is mounted within the housing and produces an audible signal simulating the sound of a power tool. The sounding device includes a flywheel, pullstring, and a wafer-type leaf spring movable into engagement with a sounding gear to produce the audible sounds. A blade guard is biased by a spring outwardly with respect to the housing so that as the housing is placed in engagement with a work piece and moved relative thereto, the blade guard moves into the housing. A cam on the blade guard engages a wafer and moves it into contact with the sounding gear to cause an audible signal to be produced.

6 Claims, 6 Drawing Figures

TOY POWER TOOL

BACKGROUND OF THE INVENTION

1. Field of the Invention

The present invention relates to toys and in particular to a toy power tool which produces an audible signal for simulating the sound of the power tool.

2. BRIEF DESCRIPTION OF THE PRIOR ART

Many miniature or toy tool sets have been provided for use by children to teach the proper use of such tools in a make-believe or play setting. Children using such devices can learn the proper manner in which to safely handle or use various tools and which tools are appropriate for a particular job. Thus, a need has arisen for a safe inexpensive toy power tool which can be safely used by children without requiring strict parental supervision.

Typical of these prior art devices are U.S. Pat. Nos. 2,627,698, 2,829,285 and 3,859,749, all of which show toys simulating power drills. Also pertinent are U.S. Pat. Nos. 3,491,479, 3,797,163 and 2,788,613, which deal primarily with toys containing sound making apparatuses.

SUMMARY OF THE INVENTION

An object of the present invention is to provide a safe toy power tool which includes a sounding device to produce an audible signal simulating the sound of a power tool.

In accordance with the above and other objects, a toy power tool is disclosed which includes the provision of an external housing in the shape of a power tool and a handle portion for grasping by the user. A selectively operable sounding means is mounted within the housing and produces an audible signal simulating the sound of a power tool. The sounding means includes a flywheel, a pullstring and a wafer or leaf spring in engagement with a sounding gear to produce the audible sounds. A blade guard is biased by a spring outwardly with respect to the housing so that, as the housing is placed in engagement with a work piece and moved relative thereto, the blade guard moves into the housing. A cam thereon engages a wafer which is moved into engagement with the sounding gear to cause the audible signal to be produced. In the preferred embodiment, the toy power tool resembles a circular saw but may be made in any desired shape to represent one of many various power tools.

Other objects, features and advantages of the invention will be apparent from the following detailed description taken in connection with the accompanying drawings.

DESCRIPTION OF THE PREFERRED EMBODIMENT

Figure 1:
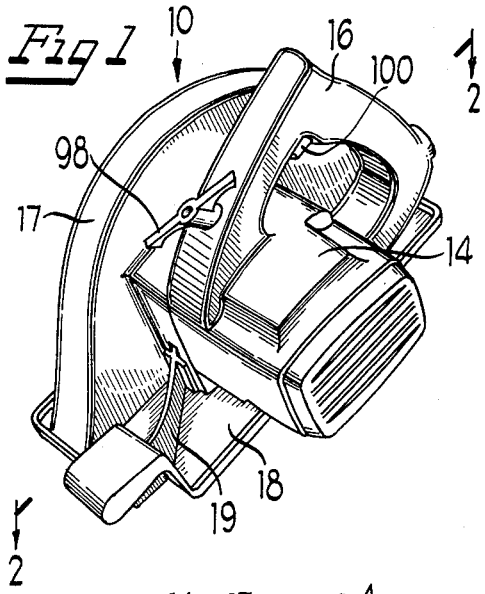
FIG. 1 is a perspective view of a toy power tool made in accordance with the concepts of the present invention.

The power tool of the present invention, generally designated 10, is shown in FIG. 1 to be in the form and shape to represent a circular saw. The circular saw 10 includes a molded housing position 14 having a hand graspable handle 16 and a blade cover portion 17. A work piece guide or foot 18 is mounted, as by flanges 19, and typically may be made of plastic, metal or other suitable material. The toy power saw 10 is designed to be used as a conventional saw to cut wood, plywood, etc. However, for safety, the saw does not utilize a blade to cut objects, but is provided with a sounding means 26 to simulate the sound of a power saw. The sounding means 26 is automatically activated by movement of the toy 10 in a conventional manner past a work piece.

Figure 5:
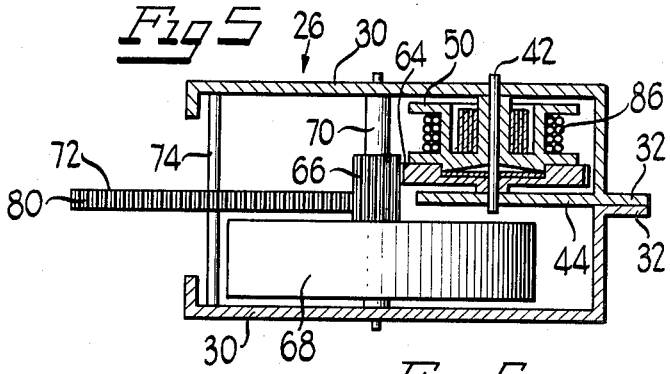
FIG. 5 is a horizontal, section on an enlarged scale, taken generally along line 5—5 of FIG. 4.
Figure 6:
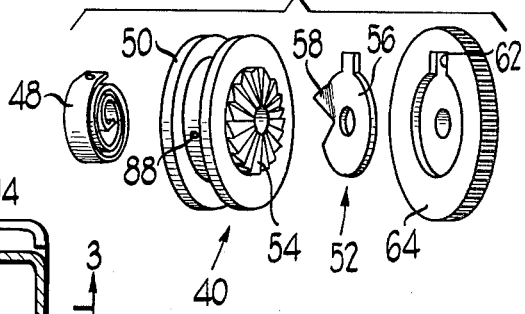
FIG. 6 is an exploded perspective view of the spring motor of the present invention.

Referring to FIGS. 2 through 6, the sounding means 26, is mounted within the housing 14 by a plurality of ribs 28 formed on the interior of the housing. The sounding means 26 includes a generally rectangular, two-part frame 30 secured together by a plurality of flanges 32 at one end and secured to the external housing at the other end by fastening means, such as adhesive screws or the like. The sounding means 26 includes a spring motor, generally designated 40, shown in an exploded perspective view in FIG. 6. The spring motor 40 is mounted by a stationary shaft 42 secured to the frame wall and an internal flange 44. Referring to FIG. 6, a spring 48 is secured on its inner end to the shaft 42 and on its outer end to a pulley 50. A one-way clutch, generally designated 52, is driven by the pulley 50 and includes a plurality of inclined surface segments 54 on the pulley 50. A clutch drive washer 56 includes a flexible tab 58 which engages the inclined surface segments 54 as the pulley rotates in a clockwise direction as shown in FIG. 6 by arrow A (counterclockwise in FIG. 4). The washer 56 includes a drive key or tab 60 engageable with a key-slot 62 in a drive gear 64. The drive gear 64, the clutch washer 56 and the pulley 50 are all rotatably mounted by appropriate apertures on the shaft 42.

The drive gear 64 engages a pinion gear 66 conjointly rotatably mounted with a flywheel 68 by a shaft 70 in the housing. The pinion gear 66 is in meshing engagement with a sounding gear 72 mounted within the frame by a shaft 74. The sounding gear 72 carries a series of teeth 80 which are selectively engageable with a leaf-type spring or wafer 84 as will be described in greater detail below.

Figure 2:
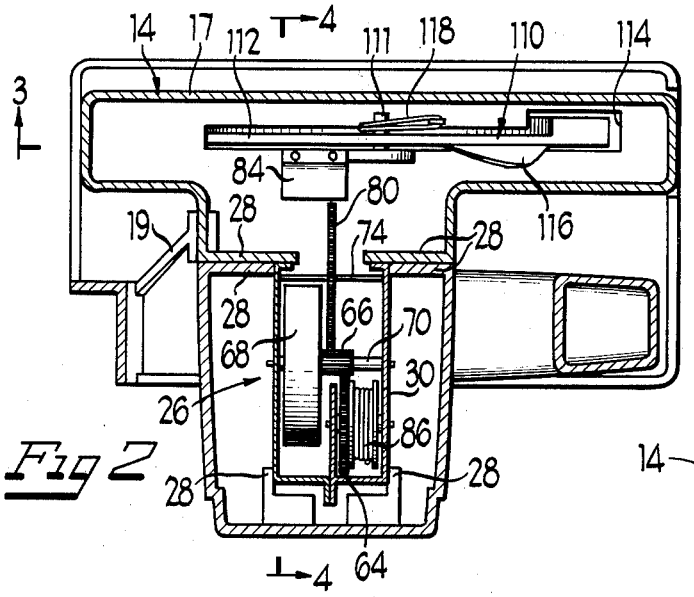
FIG. 2 is a horizontal section, on an enlarged scale, taken generally along line 2—2 of FIG. 1.

The spring motor includes a pull string 86 wrapped about the groove of the pulley 50 as shown in FIGS. 2 and 5, and secured at one end to an aperture 88 (FIG. 6) in the pulley. The pulley string 86 extends upwardly through a guide 90 and out through another guide 96 through an aperture in the handle portion 16 of the housing. A handle 98 is connected to the end of the string to facilitate winding the spring motor 40. Thus, to wind the spring motor 40, the handle 98 is pulled outwardly with respect to the housing biasing the spring 48. The pull string 86 is wound inwardly onto the pulley 50 under the force of the spring 48 after the handle 98 is released. The handle 16 also mounts a movable off-on switch 100 for added realism.

Figure 3:
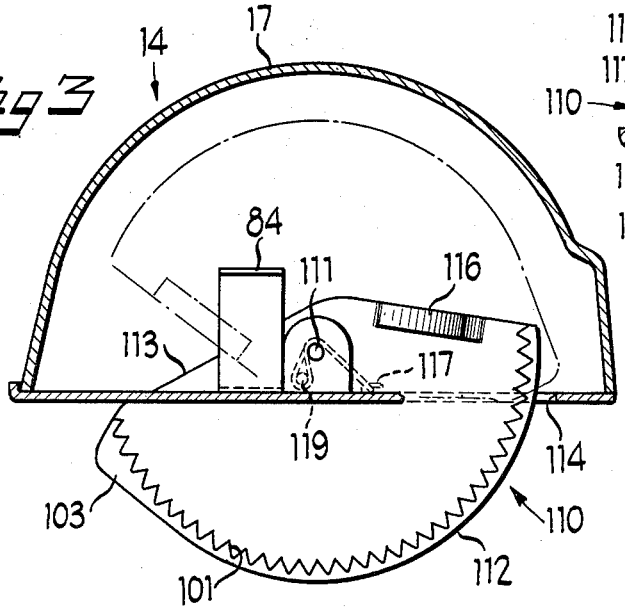
FIG. 3 is a vertical section, taken generally along line 3—3 of FIG. 2.
Figure 4:
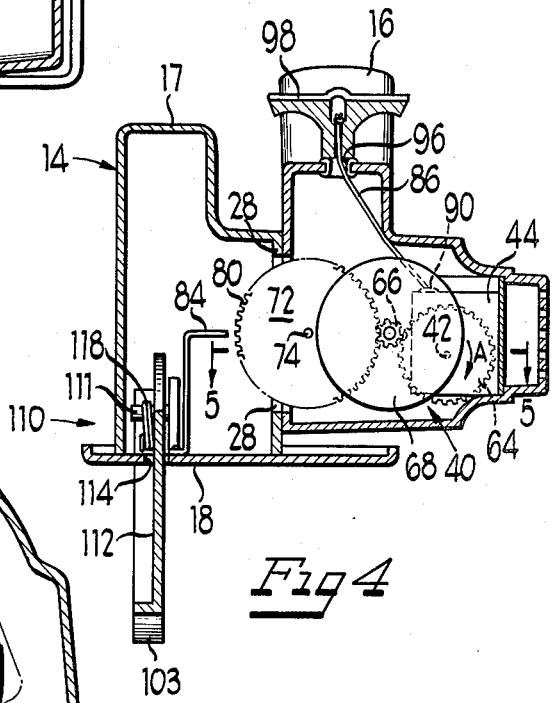
FIG. 4 is a vertical section, taken generally along line 4—4 of FIG. 3.

The sounding means 26 includes a selectively operable actuation means generally designated 110 (FIGS. 2, 3 and 5) for initiating the production of the audible signal by the sounding means 26. The actuating means includes a blade guard 112 pivotally mounted within an opening 114 in the housing by a pivot shaft 111. The edge 113 of the blade guard acts as a stop means to permit the blade guard 112 to extend outwardly with respect to the foot 18 as shown in FIG. 3 and yet, be partially retained in the housing as the edge 113 contacts the ends of the aperture 114. To further add to the toy's realism, a plurality of teeth 101 are formed on the blade guard 112. The teeth 101 are provided by a laterally extending flange 103 on the exterior side of the guard 112. The blade guard 112 is normally biased outwardly to the extended position of FIG. 3 by a spring 118 or other elastomer connected between a hook 117 on the foot 18 and a pin 119 on the blade guard 112. An actuating cam 116 is mounted on the interior side of the blade guard 112 and the sounding means is actuated by sliding the foot 18 of the circular saw relative to a work piece as follows. As this happens, the guard 112 is pivoted into the housing so that the cam 116 engages and biases the wafer 84 into the path of travel of the gear teeth 80 of the sounding gear 72, which then produces the audible signal as the wafer snaps from tooth to tooth. The sounding gear 72 is rotated by the inertia of the spinning flywheel and the spring motor 40, winds up the pull string 86.

Thus, the user can apply pressure through the housing 14 to the work piece by foot 18 and feel the vibration generated by the sounding means 26 again adding to the realism of the toy. This power tool is completely safe for use by children and does not require supervision by adults. The present invention has been shown as being embodied in a circular saw, but also is intended to emcompass its use in various other power tools such as a jigsaw, saber saw, power drill, hedge trimmer, or any other suitable power equipment.

The foregoing detailed description has been given for clearness of understanding only and no unnecessary limitations should be understood therefrom as some midifications will be obvious to those skilled in the art.

What is claimed as new and desired to be secured by Letters Patent is:

1. A toy power tool, comprising:

a housing in the shape of a power tool including means for grasping by the user;

sound generator means mounted within said housing for producing an audible signal simulating the sound of a power tool, said sound generator means including a drive means, a rotatable flywheel, a rotating element having a plurality of teeth driven by said flywheel, and a wafer normally biased out of engagement with the rotating element but movable into engagement with the teeth on said rotating element for producing a cutting sound; and a control element mounted on the housing for engaging a workpiece and being normally biased to extend out of the housing, said control element being movable relative to said housing upon engaging the workpiece and upon movement of the housing relative to the workpiece and including means for moving said wafer into engagement with the teeth of said rotating element upon said movement relative to the workpiece.

2. The toy power tool of claim 1, wherein said control element simulates a movable blade guard.

3. The toy power tool of claim 2, wherein said housing includes an integrally molded handle portion and is formed in the shape of a circular saw.

4. A toy power tool, comprising:

a housing in the shape of a power tool including an integrally molded handle for grasping by the user; and sound generator means mounted within the housing for producing an audible signal, said sound generator including a rotating motor element and pull-string for rotating the same and a selectively operable means including a vibrating element engageable with a rotating gear driven by inertia from said motor for producing an audible cutting signal as the gear rotates relative to said vibrating element, said vibrating element being normally biased out of engagement with said gear and movable into engagement therewith in response to movement of a control element, said control element being in the shape of a blade guard extending outwardly of the housing and being movable inwardly into said housing as said tool is moved relative to a workpiece, said guard including a cam for engaging said vibrating element into a variable degree of engagement with said rotating gear.

5. The toy power tool of claim 4, said blade guard having simulated cutting teeth.

6. A toy power tool, comprising:

a housing in the shape of a power tool including handle means for manipulation of the tool relative to a workpiece;

sound generator means for producing an audible signal to simulate the sound of a power tool, said sound generator means including a rotatable flywheel, a multi-toothed wheel driven by inertia supplied by said flywheel in rotation, at least one vibrating element for simulating the sound of cutting or drilling, said vibrating element having a free edge movable into and out of engagement with the rotating teeth of said wheel and means for normally biasing the free end of said vibrating element out of engagement with the rotating teeth of said wheel; and a selectively operable control means for moving the free end of said vibrating element toward said wheel in response to contact of said control means with a workpiece, said control means including cam means for variably controlling the amount of engagement of the free edge with said multi-toothed wheel depending upon the amount of movement of said control means relative to said housing in response to contact with said workpiece, said control means including a simulated blade guard on said housing for movement inwardly thereof by engagement with said workpiece.

* * * * *